United States Patent [19]

Inamorato et al.

[11] 4,082,682

[45] Apr. 4, 1978

[54] DETERGENT COMPOSITION CONTAINING DISTINCTIVE, COLORED, NON-STAINING SOAP PARTICLES

[75] Inventors: Jack Thomas Inamorato, Westfield; Leo Augustus Salmen, North Bergen, both of N.J.

[73] Assignee: Colgate-Palmolive Company, New York, N.Y.

[21] Appl. No.: 435,650

[22] Filed: Jan. 23, 1974

Related U.S. Application Data

[63] Continuation of Ser. No. 241,515, Apr. 6, 1972, abandoned.

[51] Int. Cl.[2] ..... C11D 3/40; C11D 9/44; C11D 13/08; C11D 17/06

[52] U.S. Cl. ..... 252/92; 252/89 R; 252/108; 252/109; 252/110; 252/117; 252/134; 252/135; 252/174; 252/368; 252/540; 252/559

[58] Field of Search ..... 252/109, 110, 117, 135, 252/89, 92, 108, 134, 174, 540, 559, 368

[56] References Cited

U.S. PATENT DOCUMENTS

| | | | |
|---|---|---|---|
| 2,889,283 | 6/1959 | Tecklenburg | 252/89 |
| 3,357,476 | 12/1967 | Tofflemire | 159/4 |
| 3,485,831 | 12/1969 | Dorlars | 260/240 C |
| 3,519,054 | 7/1970 | Cavataio | 159/48 |
| 3,519,570 | 7/1970 | McCarty | 252/135 |
| 3,576,748 | 3/1971 | Petersson | 252/110 |
| 3,590,001 | 6/1971 | Taylor | 252/539 X |
| 3,679,610 | 7/1972 | Sams | 252/529 |

FOREIGN PATENT DOCUMENTS

| | | | |
|---|---|---|---|
| 577,479 | 6/1959 | Canada | 252/89 |
| 1,050,127 | 12/1966 | United Kingdom | 252/109 |
| 1,204,123 | 9/1970 | United Kingdom | 252/106 |

*Primary Examiner*—Dennis L. Albrecht
*Attorney, Agent, or Firm*—Norman Blumenkopf; Herbert S. Sylvester; Murray M. Grill

[57] ABSTRACT

Distinctive detergent compositions comprise white or lightly colored, built, background detergent particles and a minor proportion of contrastingly colored (with a non-substantive colorant) elongated soap particles or rods. The soap preferably also contains specific non-sub cantive colorants and a substantial proportion of a stable fluorescent brightener.

7 Claims, No Drawings

DETERGENT COMPOSITION CONTAINING DISTINCTIVE, COLORED, NON-STAINING SOAP PARTICLES

This is a continuation, of application Ser. No. 241,515 filed Apr. 6, 1972, now abandoned.

This invention relates to particulate detergent compositions of distinctive appearance. More particularly, it is of detergents comprising white or lightly colored background particles in which there is distributed a minor proportion of readily apparent, distinctive, strongly colored elongated soap particles.

Most manufacturers of detergent products have consistently attempted to maintain distinctions between various brands and types of products by different advertising programs and strongly identifying packaging. They have also produced detergent granules of particular shapes and colors and have made speckled, mixed-color and variegated detergent products for identification and eye-appeal. In some cases, the detergent compositions and the colored particles also contained particular constituents, e.g., bleaches, fluorescent brighteners, and the colors indicated such presences. Yet, the wide variety of formulations of detergents and the limited number of useful colorants and detergent particle shapes available has made it desirable to produce additional distinctive particulate detergents which could be readily identified in bulk or after dispensing from an identifying package. Such identification allows the consumer to distinguish between detergent compositions of various formulations, e.g., non-phosphate heavy duty detergents, phosphate-containing heavy duty detergents, enzyme detergents, chlorine bleach-containing detergents, oxygen bleach-containing detergents, soap-based detergents, NTA-containing detergents and light duty detergents. This can be of particular importance where detergents are sold unpackaged, as in automatic laundries. Also, it will help to make ready identification of detergents easier in factory operations and will prevent any accidental substitution of one type of detergent for another.

Because most particulate detergents are spray dried from a crutcher mix of ingredients they are generally produced in spherical or substantially spherical shape. Therefore, the main identifying feature by which such products can be distinguished is color, either the whole product being colored or a portion thereof being colored differently from the background or base. Such products and methods for their manufacture have been described in U.S. Pat. Nos. 2,889,283 and 3,357,476. A description of color characteristics of some highly colored granules which contrast with a lightly colored base is found in U.S. Pat. No. 2,889,283 and in abandoned application Ser. No. 579,744 of B. R. Britt, referred to in that patent. Although various combinations of strongly colored and lightly colored detergent particles can be made it has been discovered that if the strongly colored particles are elongated or in rod shape they are much more readily apparent in the particulate detergent matrix than is the case when an equal volume of spherical of unidimensional strongly colored particles is substituted. Because, as will be described in the specification, elongated particles can be commercially produced (unlike particles of various other shapes which might also stand out well), heavy duty particulate detergent compositions have been made in which they are employed to replace some of the lightly colored background detergent particles. However, during storage, shipping and handling, the detergent- or composition- or phosphate-based particles would often be subjected to forces which could reduce them to shorter rods and ultimately, to essentially unidimensional particles, e.g., spheres or cylinders in which the lengths are approximately the same as the widths or diameters. Such size reduction weakens or destroys the distinctiveness and attractiveness of the product. Replacement of the more friable compositions with soaps does not solve the formulation problem because the colorants can stain laundry if the detergent is held in contact with it, even in wash water. The detergent composition of the present invention, however, maintains the integrity of the contrastingly colored rods or elongated particles during storage, shipment and handling, keeps them evenly dispersed in the mass of detergent particles without settling difficulties, and does not stain laundry, and the soap of the colord particles contributes additional desired properties to the detergent composition.

In accordance with the present invention a detergent composition of distinctive appearance comprises a major proportion of substantially unidimensional detergent particles which are white or lightly colored and a minor proportion of elongated soap particles which are contrastingly colored with a non-substantive colorant, the detergent particles containing water softening and detergent building compounds, which, upon dissolving of such detergent particles in water containing hardness ions, react with the hardness ions and assist in preventing such hardness from reacting with the soap of the elongated particles, which is slower to dissolve, thereby inhibiting production of soap curd in the wash water and aiding in prevention of colorant from being entrapped in or otherwise held to any insoluble soap that could otherwise be produced and deposited on any materials washed with the detergent on which such insoluble soap could otherwise be deposited.

The base or background particles of the present compositions, which are white, natural or light colored and against which the elongated soap particles stand out visually, are built detergents, preferably in hollow bead spray dried form and constitute a major proportion of the particulate detergent product, inclusive of the elongated soap particles. Normally they will be from 90 to 99.7% of the product by weight and usually from 95.0 to 99.5% thereof. In most preferred embodiments of the invention as little as 1 to 2% of the colored soap particles stand out against the background detergent and in such products the base detergent beads will be from 98 to 99%. The background detergent particles comprise a synthetic organic detergent and a builder for it. Such builder will normally have water softening properties and will prevent hardness ions in the normal wash water from interfering with the solubility or detersive effects of the detergent. Also, such builders prevent the precipitation of insoluble soaps by the hardness in the wash water.

The synthetic organic detergent of such detergent compositions is one in which the principal detersive ingredient is usually an anionic detergent. Nonionic detergents are also useful and preferred compositions include both the anionic and nonionic detergents. Mixtures of such materials and amphoterics may also be used. The anionic detergents will normally contain from 8 to 26, preferably 10 to 20 carbon atoms in a higher organic hydrophobic group, and will have present at least one water-solubilizing radical selected from the group consisting of sulfonates, sulfates, carboxylates, phosphates and phosphonates, to produce a water soluble detergent. Among suitable anionic detergents are water soluble sulfated and sulfonated synthetic detergents containing an alkyl radical of 8 to 20, preferably 12 to 18 carbon atoms. Such radical may be a portion of a higher acyl group. Examples of sulfonated anionic detergents are the higher alkyl aromatic sulfonates, such as the linear higher alkyl benzene sulfonates containing from 10 to 18 atoms in the higher alkyl group. Branched chain materials may also be used, but are not preferred. The sodium, potassium, ammonium and lower alkanolamine salts of such sulfonic acids are preferred. In some cases, higher alkyl toluene sulfonates are higher alkyl naphthalene sulfonates may be beneficially employed. Of the linear alkyl benzene sulfonates, those of 12 to 15 carbon atoms in the chain and wherein the salt-forming cation is sodium are much preferred. These usually will be terminally or 2-substituted on the benzene ring. However, other points of joinder to the benzene may be employed and the main factor in producing a successful detergent of this type is to have the chain linear so as to promote biodegradability of the product.

Included among other anionic detergents which may be used are the olefin sulfonates, e.g., long chain alkene sulfonates, long chain hydroxyalkane sulfonates and mixtures thereof. These are generally of 8 to 25 carbon atoms, preferably of 12 to 20 carbon atoms. Also useful are the paraffin-derived sulfonates containing about 10 to 20, preferably 15 to 20 carbon atoms. Examples are the primary paraffin sulfonates made by reaction of long chain alpha olefins with bisulfites, and those compounds having the sulfonate group distributed along the paraffin chain. Sodium and potassium sulfates of higher alcohols containing 8 to 18 carbon atoms, such as sodium lauryl sulfate and sodium tallow alcohol sulfate may be employed, as may be the sodium and potassium salts of alpha-sulfofatty acid esters of 10 to 20 carbon atoms in the acyl group, e.g., methyl alpha-sulfomyristate and methyl alpha-sulfotallowate. The sodium and ammonium sulfates of mono- and diglycerides of higher fatty acids, e.g., coconut oil fatty acids monoglyceride monosulfate, stearic diglyceride monosulfate, are also useful, as are the sulfated condensation products of polyethoxyethanols with fatty alcohols and the sulfonates of higher alkyl glycerol ethers. The alkyl phenyl polyethoxy ether sulfates having about 1 to 6 oxyethylene groups per molecule are useful anionic detergents when the alkyls are of about 7 to 9 carbon atoms. Such a range of carbon atoms is considered as "middle" alkyl. Other useful anionic detergents include the higher acyl sarcosides, isethionates and N-methyl taurides. These detergents, while normally used as their ammonium, alkanolamine, or alkali metal salts, may often be employed as soluble alkaline earth metal salts.

The nonionic synthetic organic detergents are usually condensation products of organic aliphatic or alkyl aromatic hydrophobic compounds and hydrophilic lower alkylene oxide groups. A wide variety of hydrophobic compounds which include carboxy, hydroxy, amido or amino groups having a free hydrogen on the nitrogen can be condensed with a lower alkylene oxide or equivalent, such as ethylene oxide, polyethylene oxide or polyethylene glycol to form the nonionic detergents. Useful hydrophobes are higher aliphatic alcohols, middle alkyl phenols, higher fatty acids, carboxamides, mercaptans and sulfonamides. The ethylene oxide condensates of such materials usually include from 5 to 50 moles of ethylene oxide but as many as 200 moles may often be present. The hydrophobic groups will generally contain at least about 6 carbon atoms but may contain as many as 50. A preferred range is from about 8 to 30 carbon atoms in the hydrophobe. The ethylene oxide or the corresponding glycol or polyderivatives thereof are preferred but other lower alkylene oxides, such as propylene oxide, may also be of use and in some cases butylene oxide can be employed, generally in minor proportions. Other nonionic compounds included as active detersive ingredients are the polyoxyalkylene esters of higher fatty acids which will generally contain from 12 to 30 moles of ethylene oxide per mole of fatty acid of 10 to 22 carbon atoms. The alkylene oxide condensates of higher fatty acid amides are useful and these will usually have present from 10 to 50 moles of ethylene oxide per mole of 8 to 22 carbon atom fatty acid group. Corresponding carboxamides and sulfonamides are also employed. Oxyalkylated higher aliphatic alcohols are especially preferred nonionic compounds, utilizable in conjunction with the linear higher alkyl benzene sulfonate anionic detergents. The fatty alcohols will usually have from 10 to 18 carbon atoms and the polyoxyethylene group will contain from 6 to 30 moles of ethylene oxide, preferably from about 6 to 12 moles thereof when the alcohol is of 12 to 16 carbon atoms. Such nonionics are sold as Neodols by Shell Chemical Company.

Hydrophobic groups of the nonionics can be made by condensing polyoxypropylene or polyoxybutylene radicals, in which case the subsequent condensation with ethylene oxide or polyoxyethylene groups results in the production of a nonionic detergent such as those sold under the names Ucon and Pluronic. In the Pluronics the block copolymers made are of ethylene oxide, propylene oxide and some propylene glycol and have a molecular weight in the range of about 1,000 to 15,000. The polyethylene oxide content thereof will usually be from 20 to 80 % by weight and the preferred hydrophobic moiety weight is from about 1,000 to 4,000. Nonionics may be derived by the condensation of ethylene oxide with the reaction product of propylene oxide and ethylene diamine, in a manner similar to that employed for the preparation of the Pluronics. Various other nonionic detergents which may be used include the ethylene oxide aducts of monoesters of hexahydric alcohols and inner ethers thereof, with the higher fatty acids being of about 10 to 20 carbon atoms, e.g., sorbitan monolaurate, mannitan monopalmitate. Additional nonionic detergents that have been found to be very useful are the amine oxides of the general formula $R^1R^2R^3N \rightarrow O$, wherein $R^1$ is a higher alkyl of 10 to 20 carbon atoms and $R^2$ and $R^3$ are lower alkyls. Similar compounds wherein the nitrogen is replaced by phosphorus are also usable.

Although normally not employed in detergent compositions, amphoteric detergents are useful. These are generally water soluble salts of derivatives of aliphatic amines which contain at least one cationic group, e.g., quaternary ammonium, non-quaternary nitrogen or quaternary phosphonium, one or two alkyl groups of about 8 to 18 carbon atoms and an anionic water solubilizing carboxyl, sulfo, sulfato, phosphato or phosphono group. The groups may be straight chained or branched and the cationic nitrogen or phosphorus may be in a heterocyclic ring. Examples of such amphoteric detergents include the alkyl beta-aminopropionates, the alkyl betaiminodipropionates, the alkyl and hydroxyalkyl taurinates and the long chain imidazole derivatives, such as those described in British Pat. No. 1,412,921 and U.S. Pat. No. 2,773,068, 2,781,354 and 2,781,357. Preferred detergents of this type are sodium N-lauryl beta-aminopropionate and disodium N-lauryl iminodipropionate.

Cationic surface active agents are usually avoided in the present detergent compositions but may be employed when there are no anionics present or when a laundry treating composition is used primarily for its antibacterial activity. Examples of the cationic detergents are the normal primary amines wherein the alkyl group is of 12 to 15 carbon atoms, and the corresponding diamines. Quaternary ammonium compounds of the known type, preferably those having 1 or 2 higher alkyl groups and 2 or 3 lower alkyl groups attached to the nitrogen and wherein the solubilizing anion is a halogen are also useful, as are equivalent quaternaries of high antibacterial activity, which are well known in the art.

It is recognized that some of the mentioned organic detergents may be liquid, pasty or waxy products and they will normally be employed either in mixture with harder synthetic organic detergents or with a sufficient proportion of builder salts and such adjuvants as will make them sufficiently firm to be form-retaining and free-flowing. Also, with respect to liquid detergents, only minor proportions thereof, usually less than 10%, will be employed and then only to the extent that such detergents are sorbable or fusible into more solid components of the products. In some cases, it may be desirable to incorporate soaps in the product, usually in minor proportion, to contribute strength to the detergent beads and to add detergency and often, foam-controlling properties to the product. The soaps will be described in more detail with reference to the strongly colored soap particles, a description of which is given subsequently.

The detergent builders that may be employed are usually the inorganic builder salts, such as alkali metal polyphosphate salts, e.g., pentasodium tripolyphosphate, tetrasodium pyrophosphate and the corresponding potassium compounds. Other builders, especially popular in formulations low in phosphate content or devoid of phosphates, are alkali metal silicates and carbonates, as well as the corresponding borates and bicarbonates. Preferably, the silicates will have an $Na_2O$:$SiO_2$ ratio of about 1:2.35, although the range of 1:2 to 1:3 is normally useful and often ratios as low as 1:3.2 are acceptable. Organic builders which are useful include the citrates, diglycolates, gluconates, ethylene diamine tetraacetic acid, sodium salt and trisodium nitrilotriacetate. Of course, mixtures of builders may be used and they may be supplemented with fillers, which generally do not perform any significantly useful function with respect to increasing the detergency of the product. Among the fillers that are useful are the sulfates, chlorides, nitrates, and acetates, usually as their alkali metal salts, e.g., sodium sulfate.

The various adjuvants that are used, in addition to the fluorescent dyes which will be described later, include germicides, fungicides, perborate bleaches, enzymes, soil suspending agents, fabric softeners, thickeners, corrosion inhibitors, sequestrants, tarnish inhibitors, perfumes and various other materials intended to improve the functional and aesthetic properties of the detergents. Most of such materials are well known in the art and will not be described here, except for a couple of the more important ones.

Among the enzymes useful are those of the proteolytic type, including subtilisin, bromelin, papain, trypsin and pepsin. Soil suspending materials, e.g., sodium carboxymethyl cellulose, methyl cellulose and hydroxypropyl methyl cellulose are also normal constituents of the detergents. Bactericidal effects may be obtained by incorporating germicides in the detergent and in a similar way, fabric softening ingredients may be utilized.

The detergent composition will generally contain from 5 to 60% of synthetic organic detergent, of which 5 to 40% will normally be synthetic anionic organic detergent and from 2 to 20% will be nonionic detergent. More preferably, the anionic detergent, which may preferably be a linear higher alkyl benzene sulfonate, alkali metal salt, will constitute from 8 to 30% of the product and the nonionic detergent will be from 2 to 10% thereof. Additionally, from 10 to 50% of a suitable builder salt will be used. In phosphate-containing detergents the amount of phosphate will be from 5 to 40%, preferably from 5 to 25%. In lower phosphate detergents the phosphate content will be held below 15% and in non-phosphate detergents less than 1% phosphate will be present, preferably 0%. In either the phosphate or non-phosphate detergents there may be present also silicates, carbonates and borates, preferably as the sodium or other alkali metal salts, and the non-phosphate detergents will contain at least 10% of silicate. The content of inorganic builder salts will be from 10 to 50%, preferably from 20 to 50%. Adjuvants will constitute less than 20% of the product, preferably 2 to 10%, and fillers, such as sodium sulfate and sodium chloride will be from 1 to 50%, preferably substantially all of the filler being there as anhydrous sodium sulfate. The product will also contain some moisture, generally from 0 to 25% but normally from 1 to 20% thereof. A typical product will have from 4 to 15% of water present and the amount of moisture and adjuvants present will not be so great as to make the product poorly flowing. Of course to be aesthetically pleasing, the detergent will normally be perfumed, with the proportion of perfume generally being from 0.1 to 1% of the product. The perfume is usually post-added to the spray dried detergent beads to avoid loss thereof during drying operation. Similarly, some or all of the nonionic detergent content may be post-sprayed onto the surfaces of the beads while they are being moved in a tumbling drum. From 1 to 10% of soap, usually a sodium soap of mixed higher fatty acids, such as those derived from tallow and coconut oil in a ratio of from 3:1 to 9:1, e.g., 85:15, may be included in the detergent composition crutcher mix and may be spray dried with it to strengthen the detergent particles and add the soap's characteristics to the beads. Normally however, from 10 to 100% of the total soap content of the final product will be in the elongated soap particles rather than in the background detergent beads. Small quantities, e.g., 2 to 20%, of nonionic detergent may be present in the soap to plasticize it, if desired, but usually the nonionic detergent will be in the background beads, of which it may be a part or all the synthetic detergent content, e.g., 5 to 40%, preferably 2 to 20%.

While it is preferable for the sake of contrast that the background or base detergent particles should be white or of natural detergent color, sometimes for aesthetic reasons it may be desired to have the particles lightly colored. By lightly colored it is meant that the Munsell chroma will generally be less than 4 and/or the value will be greater than 7, whereby a weak color or pastel results. If desired, whiteness may be accentuated by the addition of small quantities, such as from 0.1 to 2%, of pigments or white powders, e.g., titanium dioxide, and it is sometimes found that whiteness is also improved by the addition of flow-promoting agents such as Satintone (calcined aluminum silicate) or pyrogenic silica, often added to the detergent particles after completion of spray drying, especially if liquid or pasty nonionic detergent is post-sprayed onto the detergent particles. Various dyes may be employed to adjust the color of the base detergent beads, generally in very small proportions, such as from 0.001 to 1% of the beads, preferably from 0.03 to 0.1% thereof. Virtually all of the approved F.D. & C. water soluble dyes are useful and sometimes minor proportions of such oil soluble dyes are also operative, especially if mixed with the water soluble colorants. Water dispersible pigments have also been successfully employed, such as those marketed under the name Heliogen. Of course, the various dyes and pigments used should be stable to alkali because most of the built synthetic organic detergents are alkaline. It is also advantageous for the dye to be heat stable because of subjection to spray drying operations in manufacture but such instability may be overcome by post-spraying it onto the detergent particles. Among the best dyes found, being heat-, alkali- and light-stable are those identified by Color Index No's. 77007 and 42045, which produce attractive light blues on the background detergent particles when incorporated in very small proportions in the crutcher mix. They are also substantive to textiles, giving them a light blue tint after washing, which improves the white appearance of the laundry.

The colors of the dyes in both the strongly colored soap particles and the background detergent may be brightened and made more attractive by inclusion in such composition of fluorescent brighteners or optical bleach compounds. Such materials may be desirably present in the final product to an extent from 0.1 to 2%, normally from 0.2 to 1%. They act to brighten the materials washed with the detergent and at the same time they improve the appearance of the detergent particles. Such brighteners are known as cotton brighteners, bleach soluble brighteners, polyamide brighteners and polyester brighteners and generally mixtures thereof are employed so as to make the detergent useful for brightening a wide variety of materials being washed, including cottons and synthetics. Exemplary of such good brighteners are those identified as: TA; DM; DMEA; DDEA; DMDDEA; BS; NTS; BBI; AC; DP; BBO; BOS; and NTSA, in a well known article entitled *Optical Brighteners and Their Evaluation* by Per S. Stensby, published in Soap and Chemical Specialties in April, May, July, August and September, 1967. Further discussions of the fluorescent brighteners may be found in an article entitled *Optical Bleaches in the Soaps and Detergents* by F. G. Villaume, appearing in The Journal of the American Oil Chemists' Society (October 1958), Vol. 35, No. 10, pp. 558–566. Useful fluorescent dyes are sold under the trade names: Calcofluor White ALF (American Cyanamid); ALF-N (American Cyanamid); SOF A-2001 (CIBA); CWD (Hilton-Davis); Phorwite RKH (Verona); CSL, powder, acid (American Cyanamid); CSL, liquid, monoethanolamine salt (American Cyanamid); FB 766 (Verona); Blancophor PD (GAF); UNPA (Geigy); Tinopal RBS (Geigy); and RBS 200 (Geigy). The various brighteners are normally present as their water soluble salts but may also be employed in the corresponding acid forms.

The elongated soap particles employed may contain the various constituents of the detergent product previously described but preferably comprise a major proportion, over 50%, of higher fatty acid soap, such as that previously mentioned, and little or no inorganic builder salt. Surprisingly, it has been discovered that it is unnecessary to employ plasticizers to maintain the soap particles' strength and it is even possible to include a substantial proportion, often from 1 to 40%, of a fluorescent brightener in the composition, together with the coloring dye, without unduly weakening the particles. Preferably, for greatest particle strength, the fatty acids of the soap will contain over 50% of saturated fatty acids of 16 to 18 carbon atoms and the soap will be a sodium soap. Also, the particles will normally include 3 to 20% of moisture, most frequently in the detergent environment, from 3 to 15% thereof.

The dye employed to strongly color the soap particles will be a minor proportion of the soap, usually from 0.1 to 2% thereof, preferably from 0.2 to 1%. Although a wide variety of dyes may be used such as the F.D. & C. water dispersible pigments, C.I. 77007, C.I.42045, the fugitive dyes, e.g., the Versatints, none of these is as satisfactory in the product as C.I. Acid Blue 80 and C.I. Solvent Green 7 or a mixture thereof. Such dyes, employed at concentrations of 1% in soap or soap-fluorescent dye particles, and distributed in a detergent composition to the extent of 1 to 5% by weight of the elongated particles in the composition, do not stain laundry contacted with the detergent, even when the detergent particles are placed on the damp laundry and allowed to stand for periods as long as one-half hour before being washed. When sewn into swatches of laundry no stains are observed on cotton or various synthetics, after wetting, standing and washing. The dyes are stable to light and maintain color integrity of the particles during storage. Various other dyes and water dispersible pigments fade on storage in light, objectionably stain laundry when undissolved detergent and soap particles are placed in contact with damp articles and change in color when exposed to alkaline conditions. Although it is contemplated that dyes of structures similar to those of C.I. Acid Blue 80 and C.I. Solvent Green 7 may also be non-staining and stable, at the present time none is known which is equivalent to the mentioned materials in these respects.

The fluorescent dyes which may be present with the elongated soap particles brighten the particles and aid them in standing out against the background detergent beads. In this respect, they can make useful base beads which, without the presence of the fluorescent brightener, would have chroma less than 4 or values outside the 4–7 range. It is intended that particles so colored are within this invention providing that the visual effects created by them are equivalent to or better in contrast than those obtained by using normal dyes alone to produce colors within the described chroma and value ranges. Of all the fluorescent brighteners employed the most effective and most stable one, which can be used at high concentration in the soap particles, is the dipotassium salt of 4,4'-bis(4-phenyl-2H-1,2,3-triazol-2-yl)-2,2'-stilbene disulfonic acid. This material is sold under the trade name Phorwhite BHC. It may be utilized in the forms of other water soluble salts, e.g., the disodium salt, or in acid form, if desired. For simplicity, it will be referred to as BHC brightener. Almost as good as BHC is a dye of the structure:

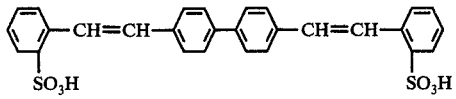

which will be referred to as bis(stilbene sulfonic acid), or its sodium, potassium and other water soluble salts.

If desired, mixtures of different light background detergent particles and/or mixtures of strongly colored, elongated soap particles may be employed. In one such preferred composition, the base beads are in a mixture of white and light blue built detergent particles and the dispersed soap particles may be strongly colored green and blue, colored by C.I. Solvent Green 7 and C.I. Acid Blue 80, respectively. Of course, the dyes may be blended to modify the colors of individual particles, too.

Detergent and soap particle sizes will be such as to result in good solubilities of the product and excellent contrasts. With the light colored background particles of low Munsell chroma and of comparatively high Munsell values and with the strongly colored elongated soap particles being of a chroma greater than 4 and a value of about 4 to 7, or equivalent, the background detergent should be of particle sizes within the range of 0.1 to 1 mm. in diameter, preferably as hollow spheres. Often, this size range will result from screening of detergent particles so as to remove those which fail to pass a No. 14 sieve and which pass through a No. 140 sieve. Preferred size ranges are through No. 20 and on No. 80 sieves. The colored soap particles are preferably rods of circular or substantially square or rounded square cross-sections but other cross-sectional shapes may also be used. In size, these will be from about 0.4 to 1.6 mm. in diameter, preferably from 0.6 to 1.4 mm. and will have lengths from about 3 to 10 times as great, usually within the 1.8 to 7 mm. range, and of $1/d$ ratios of 3 to 7.

Although in making the products of this invention it is possible to apply the various dyes and other materials to the exteriors of the particles, so as to produce uniformly colored products, it is preferred that the colors, including fluorescent dyes, be distributed evenly throughout the bodies of the detergent and soap particles.

To manufacture the products of this invention requires little in the way of special equipment. The base detergent beads are made by spray drying or equivalent technique which results in the production of essentially unidimensional particles, preferably spherules. These may be further compounded with adjuvants, flow-inducing agents, perfumes, etc. and are usually screened to produce the desired range of particle sizes. Heat stable components of the product, including synthetic organic detergent, inorganic and organic builder salts, colorants, optical brighteners and adjuvants may be included in an aqueous crutcher mix, which is sprayed at a high pressure and high solids concentration, e.g., 40 to 80%, into a drying tower in which drying air at elevated temperature, e.g., 400° to 600° F., evaporates moisture and produces the desired puffed spherical particles. These are cooled and screened to size and are post-treated, if desired. The elongated soap beads are made by amalgamating in with kettle soap chips the colorant, fluorescent dye, if present and any additional water which might be desirable for adjusting the moisture content and properties of the soap for extrusion into thin rod shape. Other adjuvants may also be included. If desired, the dyes will preferably be incorporated in the crutcher mix and with the soap chip as liquids or special care will be taken to assure that they are completely and evenly dispersed before spray drying or extrusion. The rods may be made by plodding the soap through screens of desired openings and a simple technique which has been found to be quite useful is to force the plastic soap under pressure, e.g., 100 to 1,000 p.s.i., through an ordinary wire screen having the desired openings therein. Then the extruded rods are allowed to air dry to build up a surface skin on them, after which they are screened through sieves having openings sufficiently large to result in the passage through them of rods of the desired length. For example, rods in the size range of 2 to 7 mm. are obtainable by screening through a No. 6 sieve. After manufacturing both types of particles, they are blended together in the desired proportion and the product is ready for packaging.

The particular advantages of the present invented compositions reside in the exceptionally attractive and distinctive appearance of the dispersed elongated soap particles in the detergent bead matrix, with the color contrast accentuating this. While soap particles of shorter lengths would also be useful, the elongated particles are of much more striking appearance. They are found to be non-settling and remain evenly distributed throughout the particle mass. Also, they do not break up during handling, as do elongated rods of ordinary synthetic organic detergent composition, especially those containing substantial proportions of inorganic builder salts. The soap rods are useful additives for both phosphate and non-phosphate detergents, unlike previously employed colored particles based on hydrated sodium tripolyphosphate, which would not be used in non-phosphate products. Then too, the soaps are functional, contributing detergency and foam controlling properties to the composition. Surprisingly, in the combinations with the mentioned dyes the soaps do not result in staining of the laundry, as might have been expected, considering that insoluble soaps are produced by contact of soluble soaps with hardness ions, usually calcium and magnesium, normally present in wash waters. Yet, any insolubles produced apparently do not hold the dye in contact with the laundry. It is considered that such result is at least in part attributable to the softening effects of the builders as the detergent particles initially dissolve, which prevents the slower dissolving soap from being reacted with the hardness ions and producing the undesirable insoluble soaps in comparatively large particles which could adhere to the laundry.

In summary, the products of the invention are attractive, readily identifiable, non-staining, effective detergents which are easily made and which are exceptionally stable on storage.

The following examples illustrate but do not limit the invention. Unless otherwise indicated all parts are by weight and all temperatures are in ° C.

| | Parts |
|---|---|
| Linear dodecyl benzene sulfonate, sodium salt | 18.5 |
| Neodol 45-11 (higher fatty alcohol polyethoxylate; R = 14.5 C, w/11 EtO) | 4.5 |
| Sodium soap (85:15 tallow:coco) | 4.0 |
| Sodium silicate ($Na_2O:SiO_2$ = 1:2.35) | 27.0 |

-continued

| | Parts |
|---|---|
| Sodium carboxymethyl cellulose | 2.0 |
| Sodium sulfate, anhydrous | 37.2 |
| Moisture | 5.0 |
| Calcined aluminum silicate (Satintone) | 0.5 |
| Tinopal 5BM Conc. | 0.9 |
| Oxazole Fluorescent brightener ALF (40%) | 0.05 |
| Tinopal RBS 200 | 0.05 |
| Ultramarine blue (C.I. 77007) | 0.05 |
| Erioglaucine blue dye (C.I. 42045) | 0.008 |
| Perfume | 0.2 |

A pastel blue colored particulate detergent base of the above formula is made by spray drying a 65% solids crutcher mix of the anionic organic detergent, 2% of the nonionic detergent, soap, silicate, sulfate, fluorescent brighteners and dyes at 600 lbs./sq. in. pressure through multiple spray nozzles in an 18 foot diameter 60 feet spray tower through which drying air passes countercurrently at a temperature of 500° F. Spraying is regulated so that the detergent particles are primarily in the 6 to 200 mesh range, with a major proportion thereof being in the range of 12 to 100 mesh. After drying and cooling of the particles they are screened so as to pass through a No. 20 U.S. sieve and rest on a No. 80 sieve. After such classification the detergent particles are tumbled in a tumbling drum, revolving at about 20 r.p.m. and inclined at about 5° from the horizontal, into which are sprayed the balance of the higher fatty alcohol polyethoxylate (2.5%) and perfume and in which powdered sodium carboxymethyl cellulose is mixed with the beads and the Satintone is blended in with them to promote flowability. The product resulting is screened so as to be in the 20 to 80% mesh range and is ready for blending with the more highly colored elongated soap particles.

The soap particles are made by mixing together in a soap amalgamator 58 parts of 85:15 tallow:coco sodium soap chip, containing about 10% of water, 13 parts water, 28 parts of BHC brightener and 1 part of Polar Brilliant Blue RAWL 150 (C.I. Acid Blue 80). Before addition of the blue dye it is dissolved or dispersed in water. After amalgamating, the mix is milled two times to a thickness of about 0.005 inch and is then plodded through a No. 30 mesh U.S. sieve, resulting in the production of a multiplicity of thin sphagetti-like strands, which are fluid bed air dried and transferred to a receptacle or bin. After sufficient drying to produce a protective skin on the surface and to prevent adhesion to other materials, the colored soap rods are pressed through a No. 8 sieve, resulting in breaking of some of the rods due to the screening action, and the production of strong rods substantially all of a length in the 1.8 to 7 mm. range, with diameters of 0.6 to 1.4 mm. Some changes of diameters are attributable to distortions during drying.

To 99 parts of the base beads is added one part by weight of the soap rods in a slow moving ribbon mixer whose only function is to disperse the particles. The product resulting is then packaged, stored and shipped and is ready for sale and use.

When the product of Example 1 is tested for detergency in hot and cold waters of varying hardnesses it is found to be an excellent detergent, with the content of soap aiding in reducing (controlling) foaming which would normally be obtained due to the presence of the anionic detergent. Detergency, with such low foam, is essentially equivalent to that of many phosphate-containing commercial detergents. Brightening due to the fluorescent brighteners is excellent and the BHC brightener from the soap rods effectively contributes to the overall brightening activity. In stringent dyeing tests a tablespoonful of the particulate detergent, including the highly colored rods, is sewn into swatches of various materials and these are washed in an automatic washing machine in normal manner, in both hot and cold water. After completion of the washings no objectionable dyeing effects are noted on the clothing and after repeated testings of this type no buildup of dye is seen. Also, when exposed to sunlight, the dyed particles of this composition do not fade.

When modifications are made in the above formula so that the dye employed is a mixture of equal parts of C.I. Solvent Green 7 and C.I. Acid Blue 80, a turquoise blue coloration is obtained which stands out almost as effectively against the light blue background as do the C.I. Acid Blue 80 dyed particles. When tested in a similar manner such detergent is found to be light stable and non-staining to laundry. Similar results are obtained when mixtures of soap particles dyed with C.I. Acid Blue 80 in one case and C.I. Solvent Green 7 in the other are employed and such results also obtain when the background detergent is white (undyed), when the Ultramarine Blue and Erioglaucine Blue dyes are omitted. However, if the soap particles are dyed with Ultramarine Blue or Erioglaucine Blue and are then deposited on damp wash and held there for a substantial period of time, washing does not appear to remove all of the blue coloration and a blue tint is noticeable, especially after repeated treatments of this type.

When clothing washed with the formula product is tested under a fluorescent light, no fluorescent splotchiness is noted despite the fact that the highly colored soap particles contain 28% of fluorescent dye (BHC). However, when similar percentages of others of the mentioned fluorescent dyes are employed, concentrated fluorescent effects are seen, especially noticeable under ultraviolet light. Yet, when the concentrations of the fluorescent dyes are lowered, e.g., to 5% such adverse effects are not obtained. Thus, dye concentrations of 1–40% are useful and it is preferred that they be of 20–40% and that the soap particles contain all the fluorescent brightener of the detergent product.

The above testing is repeated, utilizing a wide variety of commercial washing machines and wash cycles. Color and fluorescent dye substantivity of objectionable types are not found on towels, percale swatches, nylon swatches, acetate swatches, Banlon swatches, double knits, terrycloths and permanent press swatches so tested. When the tests are repeated, using a detergent containing 5% of the colored soap particles the wash is also satisfactory and objectionable coloration thereof is not noted.

EXAMPLE 2

| | Parts |
|---|---|
| Sodium linear tridecyl benzene sulfonate | 8.0 |
| Sodium silicate ($Na_2O:SiO_2$ = 1:2.4) | 7.0 |
| Higher fatty alcohol polyethoxylate* | 1.0 |
| Higher fatty alcohol polyethoxylate** | 4.0 |
| Sodium carboxymethyl cellulose, 65% active | 0.5 |
| Antioxidant | 0.01 |
| Pentasodium tripolyphosphate | 33.0 |
| Fluorescent brightener (mixture of stilbene brighteners and oxazole brighteners) | 0.9 |
| Water | 10.0 |
| Ultramarine Blue | 0.05 |
| Erioglaucine Supra Conc. (Geigy) | 0.007 |

-continued

| | Parts |
|---|---|
| Sodium sulfate | 35.5 |

*Higher fatty = $C_{14-15}$ and molar ratio of higher fatty alcohol:ethylene oxide = 1:11.
**Higher fatty equals $C_{12-15}$ and molar ratio of higher fatty alcohol:ethylene oxide = 1:7.

A spray dried product of this formula is made as in Example 1. As given, the formula does not include perfume or flow promoter but these are normally employed in amounts up to 1% each, although they are not necessary.

The product of the above formula is blended in the manner described in Example 1 with the highly colored soap rods of Example 1 in 98:2 proportion and the resultant mixed-color detergent is tested in the manner described in Example 1. It passes all the tests and is found to be an excellent attractive and distinctive detergent in hard and soft, warm and cold waters, useful for washing cottons and synthetics. It is non-staining, even under severe test conditions and usefully cleans and brightens textiles washed. When the proportion of soap rods is increased to 4% of the product, rather than 2%, similar results are also obtained. Thus, the invention is applicable to both phosphate and non-phosphate detergents. Furthermore, when half the sodium tripolyphosphate is replaced by trisodium nitrilotriacetate such good results are also obtained. Variations in the proportions of the synthetic organic detergents and the builder salts within the ranges given in the specification result in acceptable products, too.

EXAMPLE 3

The formula of Example 2 is modified by increasing the proportion of anionic detergent to 10%, replacing the Neodol mixture with 2% of Neodol 45-11 and adding 1% of the soap of Example 1 in the background detergent, while utilizing 0.9% of a mixture of four fluorescent brighteners in the background detergent, with no fluorescent brightener in the colored soap particles. The product is not as effective in brightening laundry washed but passes the detergency and non-staining tests well. Also, when the soap particles are 92% of the described soap, 5% of fluorescent brightener, 2.6% water and 0.4% of C.I. Acid Blue 80; or 97% soap chip, 0.6% of C.I. Solvent Green 7 and 2.4% water, light stable and non-staining products of similar detersive utilities are obtained. All such products have satisfactory contrasting and distinctive coloring effects, making them readily discernible and identifiable compared to other detergents. Such effects are even more pronounced when the background detergent is white, instead of lightly colored.

The invention has been described with respect to various illustrations and examples thereof but is not to be limited to them because it will be evident to one of skill in the art how modifications may be made, equivalents employed and substitutes utilized without departing from the spirit or scope of the invention.

What is claimed is:

1. A detergent composition of distinctive appearance which comprises from 90 to 99.7% of substantially round unidimensional detergent particles which have particles sizes within the range of 0.1 to 1 mm in diameter, said detergent particles being white or lightly colored, and comprising from 5 to 40% of synthetic organic anionic detergent, 2 to 20% synthetic nonionic organic detergent, 10 to 50% of water softening builder salt selected from the group consisting of alkali metal polyphosphates, alkali metal silicates, alkali metal carbonates, alkali metal borates, alkali metal bicarbonates, citrates, diglucolates, gluconates, ethylene diamine tetracetates and nitrilodiacetates, 1 to 50% of a filler salt selected from the group consisting of sulfates, citrates, gluconates, carbonates and borates, 0 to .20% moisture and 0.25% of adjuvants; and from 0.3 to 10% of elongated soap particles having diameters in the range of 0.4 to 1.6 mm and length to diameters ratios within the range of 3:1 to 10:1 and being colored with 0.1 to 2% of a non-substantive colorant producing in the particle a color of a Munsell chrona greater than 4 and a Munsell value of about 4 to 7 selected from the group consisting of C.I. Acid Blue 80, C.I. solvent Green 7 and mixtures thereof and which comprise over 50% of A $C_{16}$ to $C_{18}$ saturated fatty acid soap and from 3 to 20% of moisture; the builder salt, upon dissolving of such detergent particules in water containing hardness ions, assisting in preventing such hardness from reacting with the soap of the elongated particles, which is slower to dissolve, thereby inhibiting production of soap curd in the wash water and aiding in prevention of colorant from being held to insoluble soap that would otherwise be produced and deposited on materials washed with the detergent.

2. A detergent composition according to claim 1 wherein the rounded spray dried detergent particles comprise 0.001 to 1% of dye selected from the group consisting of C.I. 77007, C.I. 42045 and mixtures thereof, said dye providing detergent particles with a Munsell value greater than 7.

3. A detergent composition according to claim 2 wherein the rounded spray dried detergent particles are dyed with from 0.03 to 0.1% of the dye, the soap of the elongated soap particles is a sodium soap, and said soap particles are rods containing from 1 to 40% of fluorescent brightening agent selected from the group consisting of cotton brighteners, bleach stable brighteners, polyamide brighteners, polyester brighteners and mixtures thereof.

4. A detergent composition according to claim 3 wherein the fluorescent brightening agent in the soap particles is 4,4'-bis(4-phenyl-2H-1,2,3-triazol-2-yl)-2,2'-stilbene disulfonic acid or a water soluble salt thereof and the proportion thereof present in the particles is from 20 to 40%.

5. A detergent composition according to claim 3 wherein the spray dried particles comprise about 8% of linear tridecyl benzene sodium sulfonate, 7% of sodium silicate of $Na_2O:SiO_2$ ratio of about 1:2.4, 1% of higher fatty alcohol polyethoxylate wherein the higher fatty alcohol is of about 15 carbon atoms and the molar ratio of ethylene oxide to higher fatty alcohol is about 11:1, 4% of higher fatty alcohol polyethoxylate wherein the higher fatty alcohol is of about 14 carbon atoms and the molar ratio of ethylene oxide to higher fatty alcohol is about 7:1, 0.3% of sodium carboxymethyl cellulose, 10% moisture, 33% pentasodium tripolyphosphate, 36% anhydrous sodium sulfate and 1% of fluorescent brightener, and the elongated soap particles consist essentially of about 58% of sodium soap of an 85:15 tallow:coco ratio, 13% of water, 28% dipotassium salt of 4,4'-bis(4-phenyl-2H-1,2,3-triazol-2-yl)-2,2'-stilbene disulfonic acid and about 1% of C.I. Acid Blue 80 dye, the particle sizes of the spray dried detergent particles are substantially within the range of 0.2 to 0.8mm. and the sizes of the elongated soap particles are 0.6 to 1.4mm. in diameter and of a length of from 1.8 to 7mm.

6. A detergent composition according to claim 3 wherein the spray dried detergent particles comprise about 19% of linear dodecyl or tridecyl benzene sodium sulfonate, 27% of sodium silicate of $Na_2O:SiO_2$ ratio of about 1:2.4, 5% of higher fatty alcohol polyethoxylate wherein the higher fatty alcohol is of about 15 carbon atoms and the molar ratio of ethylene oxide to higher fatty alcohol is about 11:1, 4% of sodium tallowcoco soap of tallow-coco ratio of about 85:15, 2% of sodium carboxymethyl cellulose, 5% of water, 37% of sodium sulfate, 1.0% of fluorescent brightener, and 0.2% of perfume, and the elongated soap particles consist essentially of about 58% of sodium soap of an 85:15 tallow-coco ratio, 13% of water, 28% dipotassium salt of 4,4'-bis(4-phenyl-2H-1,2,3-triazol-2-yl)-2,2'-stilbene disulfonic acid and 1% of C.I. Acid Blue 80 dye, the particle sizes of the spray dried particles are substantially within the range of 0.2 to 0.8mm, and the sizes of the elongated soap particles are 0.6 to 1.4mm, in diameter and of a length from 1.8 to 7mm.

7. A detergent composition according to claim 1 wherein the elongated soap particles contain from 1 to 40% of 4,4'-bis(4-phenyl-2H-1,2,3-triazol-2-yl)-2,2'-stilbene disulfonic acid or a water soluble salt thereof.

* * * * *